US008072158B2

(12) United States Patent
Nerone

(10) Patent No.: US 8,072,158 B2
(45) Date of Patent: Dec. 6, 2011

(54) DIMMING INTERFACE FOR POWER LINE

(75) Inventor: Louis Robert Nerone, Brecksville, OH (US)

(73) Assignee: General Electric Company, Schenectady, NY (US)

( * ) Notice: Subject to any disclaimer, the term of this patent is extended or adjusted under 35 U.S.C. 154(b) by 399 days.

(21) Appl. No.: 12/410,846

(22) Filed: Mar. 25, 2009

(65) Prior Publication Data

US 2010/0244730 A1 Sep. 30, 2010

(51) Int. Cl.
*G05F 1/00* (2006.01)
*H05B 37/02* (2006.01)

(52) U.S. Cl. ..... 315/294; 315/291; 315/200 R; 315/209 R; 315/312

(58) Field of Classification Search ..... 315/200 R, 315/209 R, 224, 274, 276, 291, 312, DIG. 4
See application file for complete search history.

(56) References Cited

U.S. PATENT DOCUMENTS

| | | | | |
|---|---|---|---|---|
| 5,982,111 | A | 11/1999 | Moisin | |
| 6,329,767 | B1 | 12/2001 | Sievers | |
| 7,218,063 | B2 | 5/2007 | Konopka et al. | |
| 7,764,479 | B2 * | 7/2010 | Chitta et al. | 361/91.6 |
| 7,808,191 | B2 * | 10/2010 | Wu | 315/307 |
| 7,816,872 | B2 * | 10/2010 | Nerone et al. | 315/224 |
| 2004/0100205 | A1 | 5/2004 | Takahashi et al. | |
| 2004/0113564 | A1 | 6/2004 | Glaser et al. | |
| 2004/0135523 | A1 | 7/2004 | Takahashi et al. | |
| 2007/0176564 | A1 | 8/2007 | Nerone et al. | |
| 2008/0203940 | A1 * | 8/2008 | Wu | 315/291 |
| 2009/0218953 | A1 | 9/2009 | Nerone et al. | |

FOREIGN PATENT DOCUMENTS

| | | | |
|---|---|---|---|
| EP | 1435764 | A1 | 7/2004 |
| WO | 2009013656 | A1 | 1/2009 |

OTHER PUBLICATIONS

PCT/US2010/024288, Search Report and Written Opinion, Jun. 9, 2010.
U.S. Appl. No. 12/040,216, filed Feb. 29, 2008, Nerone et al.

* cited by examiner

*Primary Examiner* — Vibol Tan
(74) *Attorney, Agent, or Firm* — Fay Sharpe LLP

(57) ABSTRACT

An interface circuit for a lamp ballast includes first and second input power lines, L1 and L2, with first and second respective switches, and a neutral power line N, all coupled to a diode bridge. Closing one of the first or second input power lines L1 or L2 causes a photodiode in an opto-isolator coupled to the diode bridge to turn ON, which in turn causes a MOSFET in a control circuit to be in an open state. When in the open state, a first resistor coupled to the source of the MOSFET is included in the control circuit and causes a lamp attached thereto to operate in a dimmed state. When both input power line switches are closed, L1 and L2 are both coupled to the diode bridge and thereby cause the phototransistor to be in an OFF state, which causes the MOSFET to close, thereby including a second resistor, coupled to the drain of the MOSFET, in the control circuit in parallel with the first resistor. This in turn causes the lamp to operate at full intensity.

17 Claims, 3 Drawing Sheets

DIMMING INTERFACE FOR POWER LINE

BACKGROUND OF THE INVENTION

The present application relates to electronic lighting. More specifically, it relates to a dimming interface for a power line and will be described with particular reference thereto. It is to be appreciated that the present interface can also be used in other lighting applications and/or other power line applications, and is not limited to the aforementioned application.

In the past, dimmable ballast systems have typically been composed of multiple discrete ballasts. In order to achieve a lower light output, one or more of the ballasts would be shut off. Conversely, when greater light output is desired, more ballasts are activated. This approach has the drawback of only being able to produce discrete levels of light output. With each ballast only able to produce a single light output, the aggregate output is limited to what the various combinations of the ballasts present can produce. Moreover, this setup also requires multiple lamps for the same space to be lighted, resulting in an inefficient use of space.

Another approach in dimmable lighting applications has been to dim a single ballast by varying the operating voltage of the ballast, that is, by varying the voltage of the high frequency signal used to power the lamp. One drawback in such a system is that as the voltage of the high frequency signal is diminished, the lamp cathodes cool down. This can lead to the lamp extinguishing, and unnecessary damage to the cathodes. To avoid this problem, such systems apply an external cathode heating. While this solves the problem of premature extinguishing, the ballast is drawing power that is not being used to power the lamp. This decreases the overall efficiency of the ballast.

Another option is to reduce the range from full light output to a lower light output, but not low enough that external cathode heating is required. In T8 lamps, this amounts to a ballast that can change the lamp current from a high ballast factor level (typically 265 mA of arc current) to a low ballast factor level of only 140 mA. This provides a dimming range where a considerable amount of energy can be saved without sacrificing too much light. Associated with this high-low ballast factor approach is the interface between the power line and the ballast control input, which determines the light level. Conventional dimming interfaces have 2 output levels: a high ballast factor at which full power is output, and a low ballast factor at which less than full power is output. A drawback of conventional dimming interfaces is that they are subject to capacitive loading by non-dimming ballasts coupled to the circuit, which can cause the dimming interface to malfunction.

The following description provides new systems and methods that overcome the above referenced problem caused by capacitive loading by other dimming or non-dimming ballasts.

BRIEF DESCRIPTION OF THE INVENTION

A first input power line L1 with a first switch, a second input power line L2 with a second switch, and a neutral input power line N comprise the external power source to which the ballast is connected. The interface circuit comprises a diode bridge to which the first input power line is coupled via the first switch; to which the second input power line is coupled via the second switch; and to which the neutral power line is directly coupled. The interface circuit further comprises a phototransistor that is in an OFF state when the first and second switches are closed so that the first and second input lines are connected to the diode bridge, and is in an ON state when only one of the first and second switches are closed.

According to another aspect, a control circuit for a dimming interface circuit for controlling an electric device comprises a MOSFET that has a source coupled to a first resistor and a drain coupled to a second resistor, wherein the second resistor is excluded from the circuit when the MOSFET is open, and wherein the second resistor is included in the circuit, in parallel with the first resistor, when the MOSFET is closed.

According to yet another aspect, a method of dimming one or more lamps comprises providing first and second switchable input power lines L1 and L2, and a neutral power line N, and closing one of the switchable input power lines L1 or L2 to cause a phototransistor in an interface circuit to turn ON, which causes a MOSFET in a control circuit to be in an open state during which at least one lamp coupled to the control circuit is in a dimmed state. The method further comprises closing both of the switchable input power lines L1 and L2 to cause a phototransistor to turn OFF, which causes the MOSFET to be in a closed state during which the at least one lamp is in a non-dimmed state.

DETAILED DESCRIPTION OF THE INVENTION

The following relates to a dimming interface or ballast for a power line. The dimming ballast mitigates capacitive loading caused by non-dimming interfaces or ballasts coupled to the same power line. The described dimming ballast is insensitive to the capacitive loading caused by non-dimming ballasts.

Figure 1:
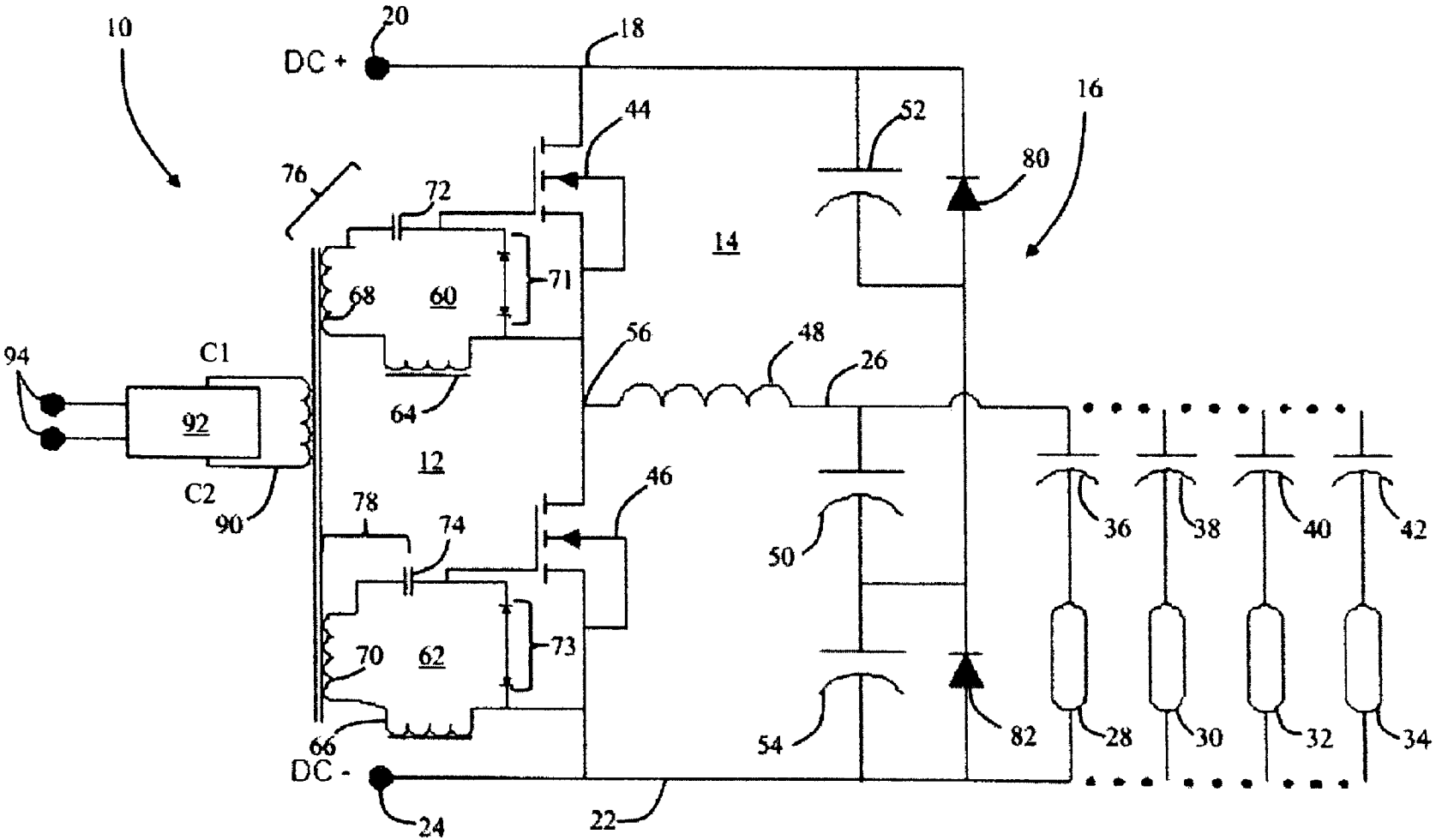
FIG. 1 a ballast circuit, such as an instant start ballast or the like, which may be employed in conjunction with the herein-described dimming interface circuit.

With reference to FIG. 1, a ballast circuit 10, such as an instant start ballast or the like, which may be employed in conjunction with the herein-described dimming interface circuit 92. The ballast circuit includes an inverter circuit 12 resonant circuit or network 14, and a clamping circuit 16. A DC voltage is supplied to the inverter 12 via a positive bus rail 18 running from a positive voltage terminal 20. DC voltage is derived from the PFC stage. The circuit 10 completes at a common conductor 22 connected to a ground or common terminal 24. A high frequency bus 26 is generated by the resonant circuit 14 as described in more detail below. First, second, third, through $n^{th}$ lamps 28, 30, 32, 34 are coupled to the high frequency bus 26 via first, second, third, and $n^{th}$ ballasting capacitors 36, 38, 40, 42. Thus, if one lamp is removed, the others continue to operate. It is contemplated that any number of lamps can be connected to the high frequency bus 26. E.g., lamps 28, 30, 32, 34 are coupled to the high frequency bus 26 via an associated ballasting capacitor 36, 38, 40, 42.

The inverter 12 includes analogous upper and lower, that is, first and second switches 44 and 46, for example, two n-channel MOSFET devices (as shown), serially connected between conductors 18 and 22, to excite the resonant circuit 14. It is to be understood that other types of transistors, such as p-channel MOSFETs, other field effect transistors, or bipolar junction transistors may also be so configured. The high frequency bus 26 is generated by the inverter 12 and the resonant circuit 14 and includes a resonant inductor 48 and an equivalent resonant capacitance that includes the equivalence of first, second, and third capacitors 50, 52, 54 and ballasting capacitors 36, 38, 40, 42 which also prevent DC current from flowing through the lamps 28, 30, 32, 34. Although they do contribute to the resonant circuit, the ballasting capacitors 36, 38, 40, 42 are primarily used as ballasting capacitors. The switches 44 and 46 cooperate to provide a square wave at a common first node 56 to excite the resonant circuit 14.

First and second gate drive circuits, generally designated 60 and 62, respectively, include first and second driving inductors 64, 66 that are secondary windings mutually coupled to the resonant inductor 48 to induce a voltage in the driving inductors 64, 66 proportional to the instantaneous rate of change of current in the resonant circuit 14. First and second secondary inductors 68, 70 are serially connected to the first and second driving inductors 64, 66 and the gates of switches 44 and 46. The gate drive circuits 60, 62 are used to control the operation of the respective upper and lower switches 44, 46. More particularly, the gate drive circuits 60, 62 maintain the upper switch 44 "on" for a first half cycle and the lower switch 46 "on" for a second half cycle. The square wave is generated at the node 56 and is used to excite the resonant circuit. First and second bi-directional voltage clamps 71, 73 are connected in parallel to the secondary inductors 68, 70, respectively, each including a pair of back-to-back Zener diodes. The bi-directional voltage clamps 71, 73 act to clamp positive and negative excursions of gate-to-source voltage to respective limits determined by the voltage ratings of the back-to-back Zener diodes. Each bi-directional voltage clamp 71, 73 cooperates with the respective first or second secondary inductor 68, 70 so that the phase angle between the fundamental frequency component of voltage across the resonant circuit 14 and the AC current in the resonant inductor 48 approaches zero during ignition of the lamps.

Upper and lower capacitors 72, 74 are connected in series with the respective first and second secondary inductors 68, 70. In the starting process, the capacitor 72 is charged from the voltage terminal 18. The voltage across the capacitor 72 is initially zero, and during the starting process, the serially connected inductors 64 and 68 act essentially as a short circuit, due to the relatively long time constant for charging the capacitor 72. When the capacitor 72 is charged to the threshold voltage of the gate-to-source voltage of the switch 44 (e.g. 2-3 Volts), the switch 44 turns ON, which results in a small bias current flowing through the switch 44. The resulting current biases the switch 44 in a common drain, Class A amplifier configuration. This produces an amplifier of sufficient gain such that the combination of the resonant circuit 14 and the gate control circuit 60 produces a regenerative action that starts the inverter into oscillation, near the resonant frequency of the network including the capacitor 72 and the inductor 68. The generated frequency is above the resonant frequency of the resonant circuit 14. This produces a resonant current that lags the fundamental of the voltage produced at the common node 56, allowing the inverter 12 to operate in the soft-switching mode prior to igniting the lamps. Thus, the inverter 12 starts operating in the linear mode and transitions into the switching Class D mode. Then, as the current builds up through the resonant circuit 14, the voltage of the high frequency bus 26 increases to ignite the lamps, while maintaining the soft-switching mode, through ignition and into the conducting, arc mode of the lamps.

During steady state operation of the ballast circuit 10, the voltage at the common node 56, being a square wave, is approximately one-half of the voltage of the positive terminal 20. The bias voltage that once existed on the capacitor 72 diminishes. The frequency of operation is such that a first network 76 including the capacitor 72 and the inductor 68 and a second network 78 that includes the capacitor 74 and the inductor 70 are equivalently inductive. That is, the frequency of operation is above the resonant frequency of the identical first and second networks 76, 78. This results in the proper phase shift of the gate circuit to allow the current flowing through the inductor 48 to lag the fundamental frequency of the voltage produced at the common node 56. Thus, soft-switching of the inverter 12 is maintained during the steady-state operation.

The output voltage of the inverter 12 is clamped by serially connected clamping diodes 80, 82 of the clamping circuit 16 to limit high voltage generated to start the lamps 28, 30, 32, 34. The clamping circuit 16 further includes the second and third capacitors 52, 54, which are essentially connected in parallel to each other. Each clamping diode 80, 82 is connected across an associated second or third capacitor 52, 54. Prior to the lamps starting, the lamps' circuits are open, since impedance of each lamp 28, 30, 32, 34 is seen as very high impedance. The resonant circuit 14 is composed of the capacitors 36, 38, 40, 42, 50, 52, and 54 and the resonant inductor 48. The resonant circuit 14 is driven near resonance. As the output voltage at the common node 56 increases, the clamping diodes 80, 82 start to clamp, preventing the voltage across the second and third capacitors 52, 54 from changing sign and limiting the output voltage to a value that does not cause overheating of the inverter 12 components. When the clamping diodes 80, 82 are clamping the second and third capacitors 52, 54 the resonant circuit 14 becomes composed of the ballast capacitors 36, 38, 40, 42 and the resonant inductor 48. That is, the resonance is achieved when the clamping diodes 80, 82 are not conducting. When the lamps ignite, the impedance decreases quickly. The voltage at the common node 52 decreases accordingly. The clamping diodes 80, 82 discontinue clamping the second and third capacitors 52, 54 as the ballast 10 enters steady state operation. The resonance is dictated again by the capacitors 36, 38, 40, 42, 50, 52, and 54 and the resonant inductor 48.

In the manner described above, the inverter 12 provides a high frequency bus 26 at the common node 56 while maintaining the soft switching condition for switches 44, 46. The inverter 12 is able to start a single lamp when the rest of the lamps are lit because there is sufficient voltage at the high frequency bus to allow for ignition. An interface inductor 90 is coupled to the inductors 68 and 70. The interface inductor 90 provides an interface between an interface circuit 92 and the inverter 12. The dimming interface circuit 92 is coupled to control leads 94 (e.g., power lines).

Figure 2:
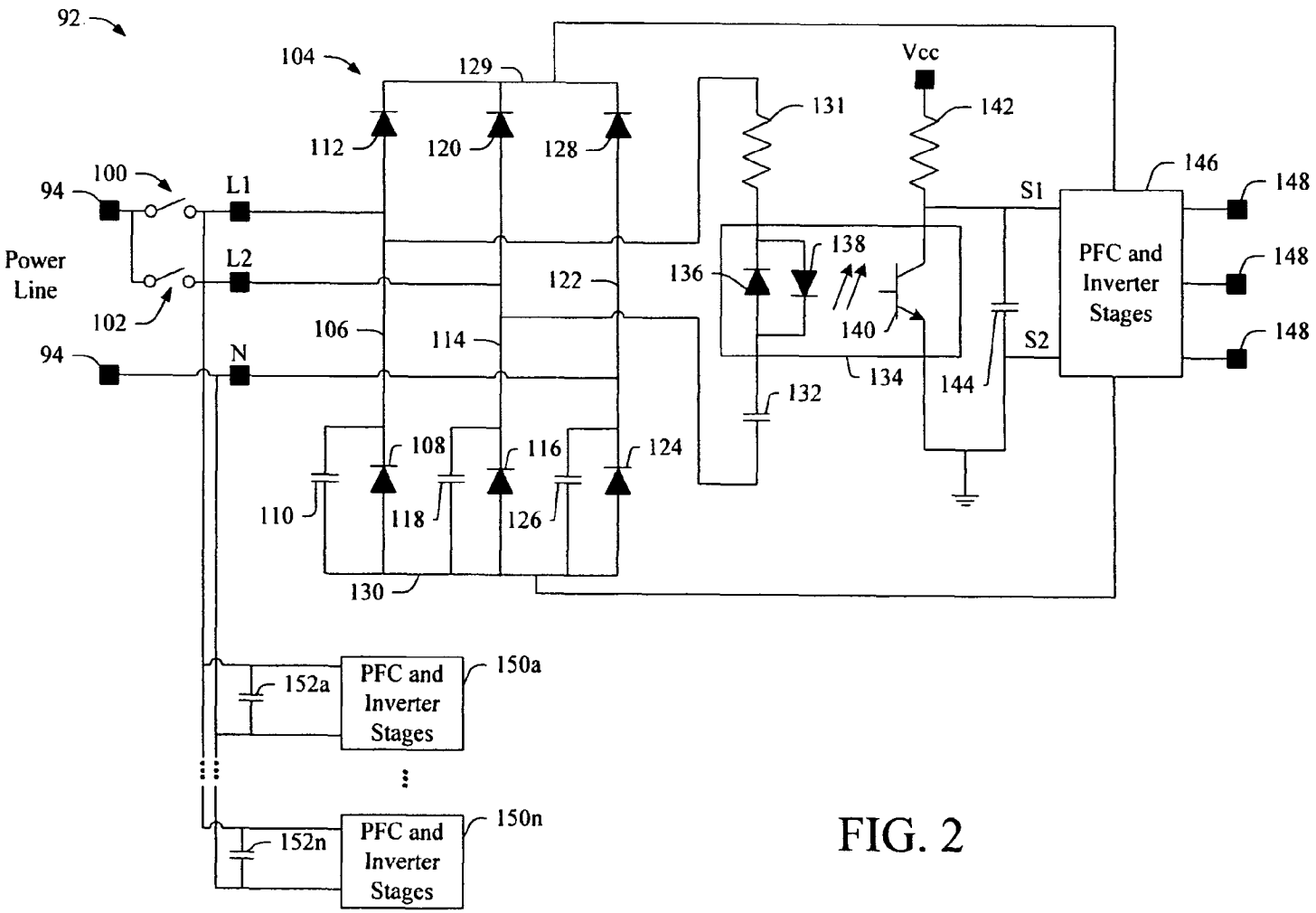
FIG. 2 illustrates the dimming interface circuit, which is insensitive to capacitive load caused by one or more non-dimming ballasts coupled to common power lines.

FIG. 2 illustrates the dimming interface circuit 92, which is insensitive to capacitive load caused by one or more non-dimming ballasts coupled to common power lines. As is known, an instant start ballasts may have interfaces to a power line that control light output. The interface described herein has three input wires, one of which is a neutral wire, N. The other two input lines, L1 and L2, control the state of dimming. If either L1 or L2 is connected to the power line, (e.g., by respective switches 100 or 102), then the ballast circuit 10 lights the lamps to a less-than-full intensity (e.g., 50-60%, or some other predetermined intensity level). When both switches 100, 102 are closed, both L1 and L2 are connected to the power line, and the ballast drives the lamps to full intensity. Thus, the ballast sheds the lighting load to a dimming level (e.g., 50-60%, or some other predetermined intensity level) when only one of lines L1 and L2 are connected to power, and drives the lamps to full intensity when both of lines L1 and L2 are connected to power. It will be understood that L1, L2 and the external switches are external to the ballast. In one example, the switches 100, 102 are wall switches. L1 and L2 are a connection to the power line.

If other ballasts (e.g. non-dimming ballasts) are connected to the switches 100, 102, they do not inhibit the operation of the interface circuit 92 due to the bridge network 104. The bridge 104 comprises a bus 106 that is coupled to L1 and to a cathode of a diode 108, which is coupled in parallel with a capacitor 110 to the bus 106. The bus 106 is further coupled to an anode of a diode 112. The bridge 104 further comprises a bus 114 that is coupled in similar fashion to L2, and to a cathode of a diode 116 that is coupled to the bus 114 in parallel with a capacitor 118. The bus 114 is further coupled to an anode of a diode 120. The bridge 104 further comprises a bus 122 that is coupled in similar fashion to the neutral line N, and to a cathode of a diode 124 that is coupled to the bus 122 in parallel with a capacitor 126. The bus 122 is further coupled to an anode of a diode 128. The cathodes of diodes 112, 120, and 128 are coupled to a common bus 129. The anodes of diodes 108, 116, and 124 are coupled to a common bus 130 in addition to the respective capacitors 110, 118, and 126, which are also coupled to the bus 130.

Bus 106 is coupled to a resistor 131, and bus 114 is coupled to a capacitor 132. The resistor 131 and capacitor 132 are coupled to an opto-isolator 134 that includes two light-emitting diodes (LED) 136 and 138, as well as a phototransistor 140. The resistor 131 is coupled to a cathode of the diode 136 and to an anode of the LED 138, and the capacitor is coupled to an anode of the diode 136 and to a cathode of the LED 138. The LEDs 136 and 138 are connected in an anti-parallel connection, anode to cathode. As the power line voltage changes polarity, each half-cycle, current can flow through each LED, thereby doubling the frequency of the signal that appears across the capacitor 144. Thus both halves of the power line can turn the phototransistor 140 on.

The phototransistor 140 is coupled line S1, and to a resistor 142 that is further coupled to Vcc. The emitter of the phototransistor 140 is coupled to ground. A capacitor 144 is coupled between lines S1 and S2, which in turn are coupled to a power factor correction (PFC) and inverter circuitry 146. The PFC an inverter circuitry 146 is coupled to one or more lamps 148. In one example, the PFC and inverter circuitry 146 includes the ballast 10 of FIG. 1, although it is not limited thereto and may comprise additional PFC circuitry as described with regard to FIG. 3.

One or more non-dimming ballasts 150*a*-150*n* may be coupled to the lines L1, L2, and N, as illustrated, each non-dimming ballast 150 has a respective capacitor 152 coupled between the connection to the neutral line N and the connection to lines L1 and L2. It is the capacitor(s) 150 that contribute a capacitive load that can cause conventional dimming interfaces or ballasts to fail. However, the bridge 104 and the opto-isolator 134 of the herein-described interface 92 make the interface insensitive to such capacitive loading, thereby permitting the dimming interface to function properly even when such non-dimming ballasts are also coupled to the lines L1, L2 and N.

In one example, the diodes 108, 112, 116, 120, 124, and 128 are S2J (General Semiconductor) diodes. The capacitors 110, 118, 126, and 132 may be 100 nf capacitors. The resistor 131 may be a 5 kΩ resistor. The resistor 142 may be a 100 kΩ resistor. The opto-isolator 134 may be a Fairchild Semiconductor FOD814. It is to be appreciated that the foregoing example(s) is/are provided for illustrative purposes and that the subject innovation is not limited to the specific values or ranges of values presented therein. Rather, the subject innovation may employ or otherwise comprise any suitable values or ranges of values, as will be appreciated by those of skill in the art.

Figure 3:
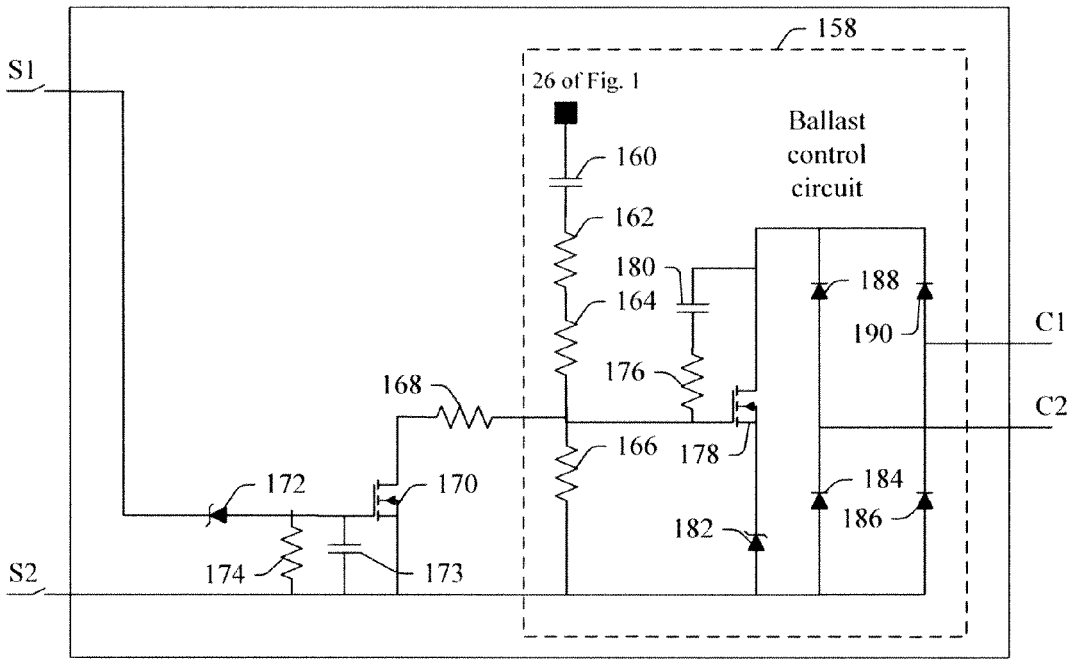
FIG. 3 illustrates a simplified view of a control circuit in the PFC and inverter circuitry that is affected by the interface circuit, in accordance with one or more aspects described herein.

With continued reference to FIG. 2, FIG. 3 illustrates a simplified view of a ballast control circuit 158 in the PFC and inverter circuitry 146 that is affected by the interface circuit 92, in accordance with one or more aspects described herein. The control circuit 158 includes a capacitor 160, a resistor 162, and a resistor 164 coupled in series, wherein the capacitor 160 is further coupled to the bus 26 of FIG. 1. The resistor 164 is coupled to a resistor 166 and a resistor 168. The resistor 168 is coupled to drain of a gate such as a MOSFET 170 (or any other suitable type of switch), while the resistor 166 is coupled to a source of the MOSFET 170. The gate of the MOSFET 170 is coupled to an anode of a Zener diode 172, to a capacitor 173, and to a resistor 174. The capacitor 173 and resistor 174 in turn are coupled to the source of the MOSFET 170, to the resistor 166, and to a switch S2. The switch S1 is coupled to the cathode of the Zener diode 172.

The control circuit 158 further includes a resistor 176 that is coupled to each of the resistors 164, 166, and 168, as well as to a gate of a MOSFET 178 and a capacitor 180. A cathode of a Zener diode 182 is coupled to a source of the MOSFET 178, and the anode of the Zener diode 182 is coupled to the resistor 166, the source of the MOSFET 170, the capacitor 173, and the resistor 174, all of which are coupled to S2. The anode of the Zener diode 182 is further coupled to the anodes of diodes 184 and 186. The drain of the MOSFET 178 is coupled to the capacitor 180 and to cathodes of diodes 188 and 190. The anode of diode 188 and the cathode of diode 184 are coupled to each other and to C1 (FIG. 1), which the anode of diode 190 and the cathode of diode 186 are coupled to each other and to C2 (FIG. 1).

When L1 or L2 is connected, the phototransistor 140 of FIG. 2 is in an ON state, and low dimming is achieved. When the phototransistor 140 is ON, the MOSFET is OFF (e.g., open), and resistor 168 is taken out of the control circuit. However, when both L1 and L2 are connected (when switches 100 and 102 are both closed), current to the opto-isolator goes to zero, and the phototransistor 140 turns OFF. This causes the MOSFET 170 to turn ON (e.g., closed), which puts resistor 168 in parallel with resistor 166, causing the lamps coupled to the PFC and inverter circuitry 156 to go high (e.g., to output light at full intensity). When L1 or L2 is disconnected again, the phototransistor 140 turns back ON and the MOSFET 170 turns OFF, removing resistor 168 from the circuit and causing the lamps to dim.

In one example, the capacitor(s) 160, may be a 100 pF capacitor. The resistors 162, 164 may be 1MΩ resistors, and the resistor 166 may be a 200 kΩ resistor. The MOSFETs 170, 178 may be BSS138 MOSFETs, and the Zener diodes 172, 182 may be 1N5232 Zener diodes. To further this example, the capacitor 173 may have a value of 1 μF, the resistor 174 may be a 100 kΩ resistor, and the resistor 174 may have a value of 10 kΩ. The capacitor 180 may be a 10 nF capacitor, and the diodes 184, 186, 188, and 190 may be 1N4148 diodes.

It is to be appreciated that the foregoing example(s) is/are provided for illustrative purposes and that the subject innovation is not limited to the specific values or ranges of values presented therein. Rather, the subject innovation may employ or otherwise comprise any suitable values or ranges of values, as will be appreciated by those of skill in the art.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A dimming interface circuit, comprising:

a first input power line L1 with a first switch;

a second input power line L2 with a second switch;

a neutral input power line N, a diode bridge:

to which the first input power line is coupled via the first switch;

to which the second input power line is coupled via the second switch; and to which the neutral power line is directly coupled; and a phototransistor that is in an OFF state when the first and second switches are closed so that the first and second input lines are connected to the diode bridge, and is in an ON state when only one of the first and second switches are closed.

2. The interface circuit as set forth in claim 1, coupled to a control circuit that includes a first resistor and a second resistor, coupled to a gate, wherein the gate is open when the phototransistor is in an ON state, causing at least one lamp coupled to the control circuit to be in dimmed state, and wherein the gate is closed when the phototransistor is in an OFF state, causing the at least one lamp to be in a full-intensity state.

3. The interface circuit as set forth in claim 2, wherein the gate is a MOSFET.

4. The interface circuit as set forth in claim 3, wherein closing one of the first switch and the second switch causes the phototransistor to enter the ON state.

5. The interface circuit as set forth in claim 3, wherein closing both of the first switch and the second switch causes the phototransistor to enter the OFF state.

6. The interface circuit as set forth in claim 2, wherein the second resistor is excluded from the control circuit when the gate is open.

7. The interface circuit as set forth in claim 1, wherein the second resistor is included the control circuit, in parallel with the first resistor when the gate is closed.

8. The interface circuit as set forth in claim 1, wherein the phototransistor is included in an opto-isolator.

9. The interface circuit as set forth in claim 8, wherein the diode bridge includes a first bus that is coupled to first and second diodes, to the first input power line L1, and to the opto-isolator via a resistor.

10. The interface circuit as set forth in claim 9, wherein the diode bridge includes a second bus that is coupled to third and fourth diodes, to the second input power line L2, and to the opto-isolator via a capacitor.

11. The interface circuit as set forth in claim 10, wherein the diode bridge includes a third bus that is coupled to fifth and sixth diodes, and to the neutral power line N.

12. A control circuit for a dimming interface circuit for controlling an electric device, comprising:

a MOSFET that has a source coupled to a first resistor, a first capacitor, and a switch S2, and a drain coupled to a second resistor;

wherein the second resistor is excluded from the circuit when the MOSFET is open;

wherein the second resistor is included in the circuit, in parallel with the first resistor, when the MOSFET is closed;

wherein the control circuit is coupled to an interface circuit with a phototransistor, wherein the MOSFET is open when the phototransistor is in an ON state, and wherein the MOSFET is closed when the phototransistor is in an OFF state; and wherein the phototransistor is included in an opto-isolator that is coupled to a diode bridge and to the control circuit.

13. The control circuit as set forth in claim 12, wherein the diode bridge comprises:

a first bus that is coupled to first and second diodes, to a first input power line L1, and to the opto-isolator via a resistor;

a second bus that is coupled to third and fourth diodes, to a second input power line L2, and to the opto-isolator via a capacitor; and a third bus that is coupled to fifth and sixth diodes, and to a neutral power line N.

14. The control circuit as set forth in claim 13, wherein the first and second input power lines are coupled to a power source by first and second switches, respectively, and wherein the phototransistor is in the ON state when one of the first and seconds switches is closed and in the OFF state when both of the first and second switches are closed.

15. A method of dimming one or more lamps, comprising:

providing first and second switchable input power lines L1 and L2, and a neutral power line N;

closing one of the switchable input power lines L1 or L2 to cause a phototransistor in an interface circuit to turn ON, which causes a MOSFET in a control circuit to be in an open state during which at least one lamp coupled to the control circuit is in a dimmed state; and closing both of the switchable input power lines L1 and L2 to cause a phototransistor to turn OFF, which causes the MOSFET to be in a closed state during which the at least one lamp is in a full-intensity state.

16. The method according to claim 15, wherein closing the MOSFET causes a second resistor to be included in the control circuit in a parallel configuration with a first resistor, thereby reducing resistance in the control circuit and permitting the at least one lamp to operate at full intensity.

17. The method according to claim 16, further including coupling one or more non-dimming ballast circuits input power lines L1 and L2, and to the input neutral power line N.

* * * * *